US005279265A

United States Patent [19]

Matsuo et al.

[11] Patent Number: 5,279,265

[45] Date of Patent: Jan. 18, 1994

[54] V-TYPE INTERNAL COMBUSTION ENGINE WITH IMPROVED WATER PUMP ARRANGEMENT

[75] Inventors: Isaya Matsuo; Tohru Higashioka; Kaoru Haga; Toshiki Ohara, all of Kanagawa, Japan

[73] Assignee: Nissan Motor Co., Ltd., Yokohama, Japan

[21] Appl. No.: 918,006

[22] Filed: Jul. 24, 1992

[30] Foreign Application Priority Data

Jul. 26, 1991 [JP] Japan ..... 3-187174
Jul. 26, 1991 [JP] Japan ..... 3-187177
Aug. 19, 1991 [JP] Japan ..... 3-206731

[51] Int. Cl.[5] ..... F01P 5/10

[52] U.S. Cl. ..... 123/41.44; 123/41.47; 123/195 C

[58] Field of Search ..... 123/41.1, 41.44, 41.47, 123/55 VF, 55 VS, 55 VE, 90.27, 90.31, 195 C, 198 C, 198 E

[56] References Cited

U.S. PATENT DOCUMENTS 2,792,820 5/1957 Leach ..... 123/41.46
5,188,065 2/1993 Lyndhurst et al. ..... 123/41.47

FOREIGN PATENT DOCUMENTS 968673 11/1951 Fed. Rep. of Germany ... 123/41.47
536254 11/1955 Italy ..... 123/41.47
62-93426 4/1987 Japan .
1-95529 6/1989 Japan .
1-37192 11/1989 Japan .
2134594 8/1984 United Kingdom ..... 123/41.44

*Primary Examiner*—Noah P. Kamen
*Attorney, Agent, or Firm*—Foley & Lardner

[57] ABSTRACT

In a V-type internal combustion engine, one bank of a cylinder block having cylinders which are offset more rearward of the engine than those of the other bank. A water pump has a pump housing installed on a front end of said one bank to define therebetween a pump chamber. The cylinder block has at a front end portion midway between the banks a coolant distributing chamber communicating with an outlet port of the pump chamber. The cylinder block has at the banks water jackets which are formed with, at respective front end portions by the side of the most forward ones of the cylinders, inlet ports opening laterally of the engine and communicating the coolant distributing chamber.

19 Claims, 9 Drawing Sheets

V-TYPE INTERNAL COMBUSTION ENGINE WITH IMPROVED WATER PUMP ARRANGEMENT

BACKGROUND OF THE INVENTION

1. Field of the Invention

The present invention relates in general to a V-type internal combustion engine and more particularly to a water pump arrangement for such an engine.

2. Description of the Prior Art

A water pump for an internal combustion engine is generally a centrifugal type and mainly consists of a pump housing secured to a front end of a cylinder block and an impeller rotatably supported on the pump housing. The water pump is driven by an engine power by way of a belt drive mechanism or the like.

In the case of a V-type internal combustion engine, it is necessary to supply coolant to the water jackets of the left and right banks of the cylinder block equally. For this reason, it has been a general practice to dispose the water pump at a front end central portion of the cylinder block between the left and right banks so that the coolant discharged from the water pump is supplied to the water jackets of the respective banks through the front ends thereof.

A problem of the prior art water pump arrangement is that the lengthwise size of the engine becomes considerably large, i.e., the water pump arrangement is an obstacle to making the engine smaller in size. In the case of a V-type internal combustion engine, the cylinders of one bank are offset more forward of the engine than the cylinders of the other bank. In the prior art arrangement, the water pump is installed on a front end portion of the cylinder block coinciding, with respect to a lengthwise direction of the engine, with the front end of the bank having the cylinders which are offset more forward of the engine, resulting in a considerably large lengthwise size of the engine.

SUMMARY OF THE INVENTION

In accordance with the present invention, there is provided a V-type internal combustion engine which comprises a cylinder block having banks one of which has cylinders which are offset more rearward of the engine than those of the other of the banks, the one bank having at a front end thereof a recessed portion, a water pump having a pump housing secured to the front end of the one bank and cooperating with the recessed portion to define a pump chamber, the cylinder block having at a front end portion between the banks a coolant distributing chamber communicating with an outlet port of the pump chamber, and the cylinder block having at the banks water jackets which are formed with, at respective front end portions by the side of the most forward ones of the cylinders, inlet ports opening laterally of the engine and communicating the coolant distributing chamber.

The above structure is effective for solving the above noted problems inherent in the prior art device.

It is accordingly an object of the present invention to provide a novel and improved V-type internal combustion engine which can reduce the lengthwise size of the engine by effectively utilizing the front end portion of one of the banks having cylinders which are offset more rearward than those of the other bank, for installation of a water pump.

It is a further object of the present invention to provide a V-type internal combustion engine of the above described character which can assuredly prevent mixing of lubricant with coolant, i.e., leakage of the water pump with respect to the chain chamber.

It is a further object of the present invention to provide a novel and improved V-type internal combustion engine which can assuredly prevent leakage of water pump even when the seal of the pump chamber is deteriorated.

It is a further object of the present invention to provide a novel and improved V-type internal combustion engine which can effectively reduce the resistance of flow from the coolant introducing chamber to the pump chamber.

It is a further object of the present invention to provide a novel and improved V-type internal combustion engine which improve the operating efficiency of the water pump while effectively reducing the tendency to cavitation.

DESCRIPTION OF THE PREFERRED EMBODIMENTS

Figure 1:
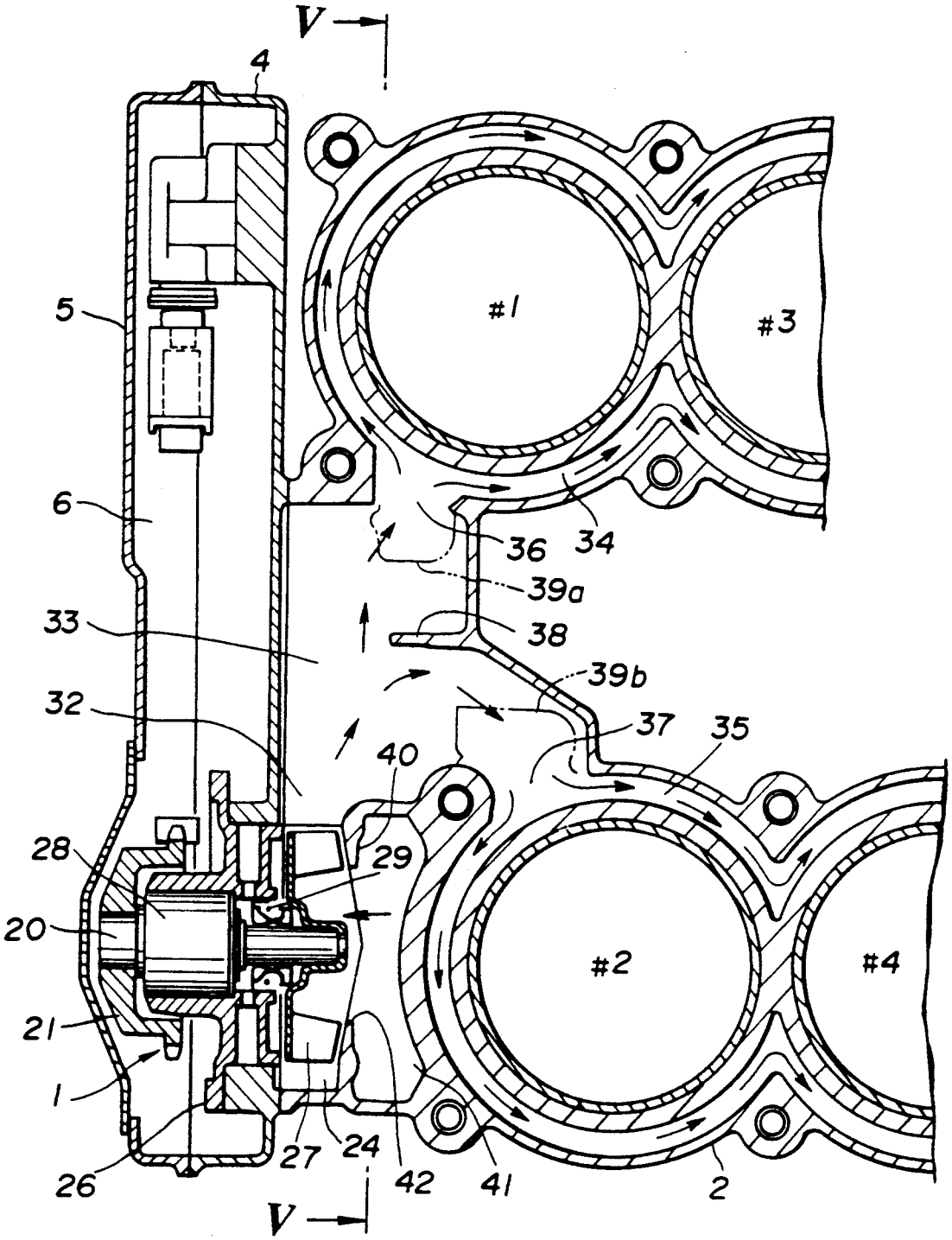
FIG. 1 is a sectional view taken along the line I—I of FIG. 2 and shows a front end portion of a V-type internal combustion engine incorporating a water pump arrangement according to an embodiment of the present invention.

Referring to FIGS. 1 through 8, inclusive, a V-6 internal combustion engine incorporating a water pump arrangement according to an embodiment of the present invention, when viewed from the front end thereof, includes #1, #3, #5 cylinders at the right bank and #2, #4, #6 cylinders at the left bank. As shown in FIG. 1, the cylinders of the right bank, from the front, are offset more rearward of the engine than the cylinders of the left bank.

Figure 3:
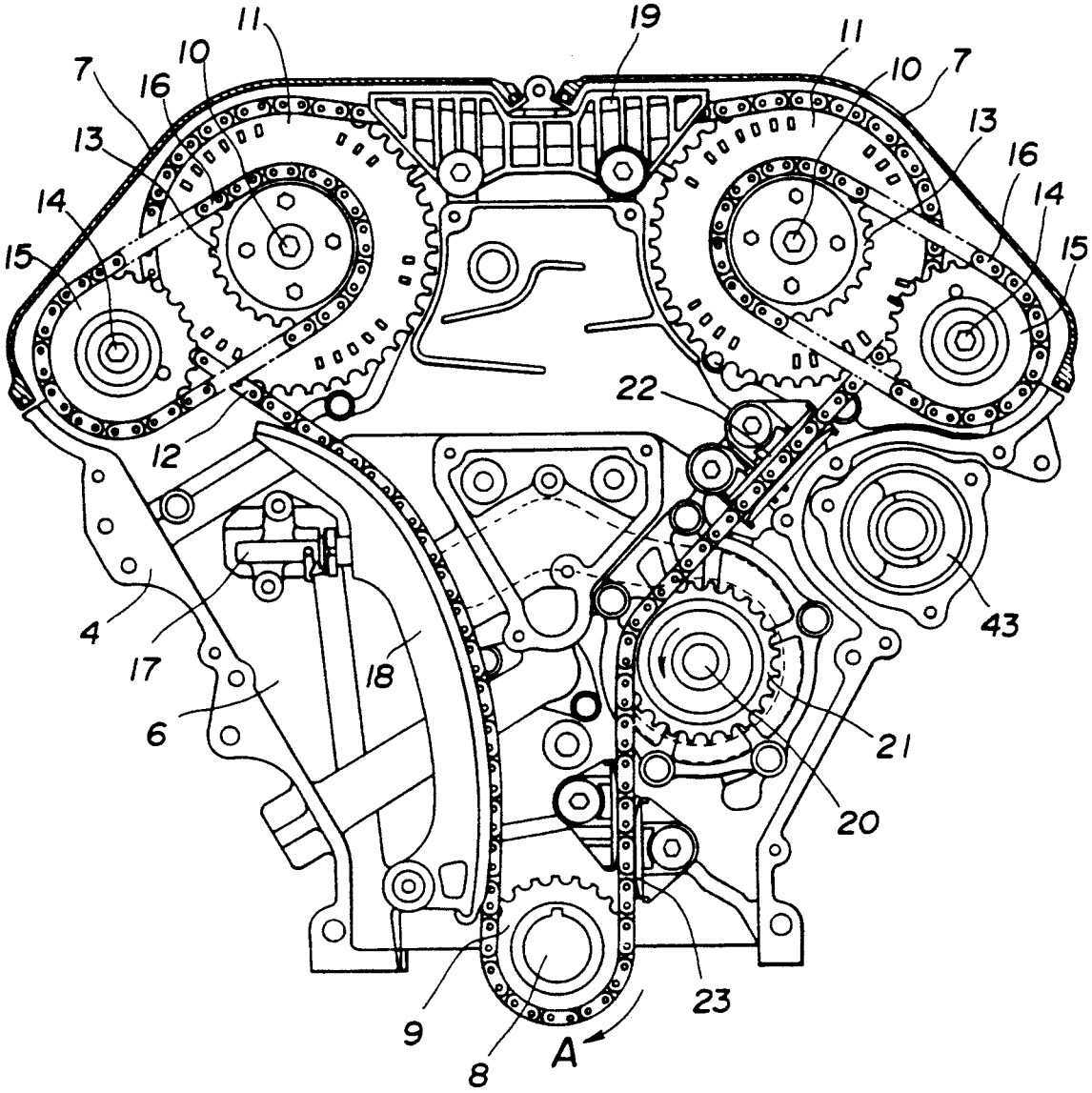
FIG. 3 is an elevational view of a chain chamber construction of the engine of FIG. 1.
Figure 4:
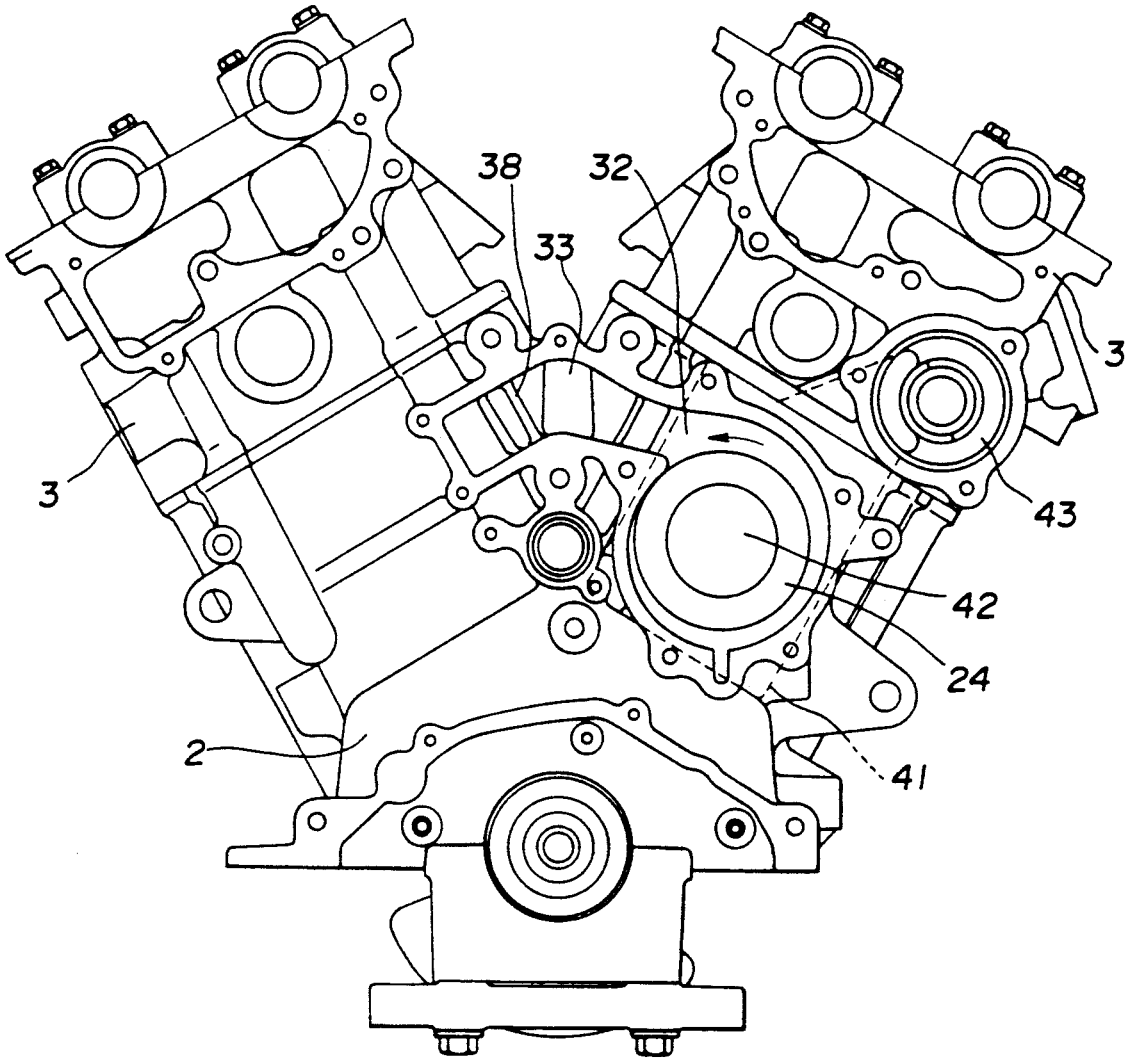
FIG. 4 is an elevational view of front end portions of a cylinder block and cylinder heads of the engine of FIG. 1.

The V-type internal combustion engine, as best seen from FIG. 4, includes a cylinder block 2 having left and right banks and cylinder heads 3 fixedly connected to the upper ends of the left and right banks of the cylinder block 2, respectively. A chain case rear member 4 in the form of a plate and made of, for example, a die cast aluminium alloy is disposed so as to cover the front ends of the cylinder block 2 and the cylinder heads 3. Installed on the front end of the chain case rear member 4 is a chain case front member 5 in the form of a cover, so as to define therebetween a chain chamber 6. The V-type internal combustion engine is shown in FIG. 3 in the state where the chain case front member 5 is removed, with a view to illustrating the inside of the chain chamber 6. FIG. 4 shows the front ends of the cylinder block 2 and the cylinder heads 3 from which the chain case rear member 4 is moved. The upper portion of the chain chamber 6 is covered by the front end portions of cylinder head covers 7.

The V-type internal combustion engine includes a valve operating mechanism of the DOHC type (i.e., double overhead camshaft type). As shown in FIG. 3, a crankshaft 8 is installed on a lower portion of the cylinder block 2. A crankshaft sprocket 9 is installed on the crankshaft 8 for rotation therewith. First intake valve operating camshaft sprockets 11 are installed on intake valve operating camshafts 10 for rotation therewith. The intake valve operating camshafts 10 are in turn installed on the respective cylinder heads 3 at the left and right banks of the cylinder block 2. A single timing chain 12 is placed around and engaged with the first intake valve operating camshaft sprockets 11 and the crankshaft sprocket 9 in such a manner as to form a nearly triangular shape. Further installed on the respective intake valve operating camshafts 10 for rotation therewith are second intake valve operating camshaft sprockets which are smaller in diameter than the first intake valve operating camshaft sprockets 11. The second intake valve operating camshaft sprockets 13 are located a little forward of the corresponding first intake valve operating camshaft sprockets 11. Each pair of first and second intake valve operating camshaft sprockets 11 and 13 are thus installed on each common camshaft 10 in such a way as to be located adjacently to each other, i.e., arranged in sequence in an axial direction of the respective intake valve operating camshafts 10 and adjacently to each other.

Exhaust valve operating camshaft sprockets 15 are installed on exhaust valve operating camshafts 14 for rotation therewith, respectively. The exhaust valve operating camshaft sprockets 15 and the second intake valve operating camshaft sprockets 13 are arranged so as to lie on a common plane extending to cross the camshafts 10 and 14 at right angles. Sub-timing chains 16 are wound around and engaged with the exhaust valve operating camshaft sprockets 15 and the second intake valve operating camshaft sprockets 13, respectively. The intake valve operating camshafts 10 installed on the cylinder heads 3 at the left and right banks of the cylinder block 2 are driven by the crankshaft 8 which rotates in the direction indicated by the arrow "A" in FIG. 1. In this connection, the first intake valve operating camshaft sprockets 11 and the crankshaft sprocket 9 are arranged so as to lie on a common plane extending to cross the camshafts 10 and 14 at right angles. The exhaust valve operating camshafts 14 are in turn driven by the intake valve operating camshafts 10 by way of the sub-timing chains 16 and rotatable in timed relation thereto. The timing chain 12, sub-timing chains 16 and the sprockets 9, 11, 13 and 15 are disposed at the front ends of the cylinder block 2 and the cylinder heads 3 and housed in the chain chamber 6.

A chain guide 18 pivotally supported at the lower end thereof and provided with a hydraulic chain tensioner 17 is disposed between one of the first intake valve operating camshaft sprockets 11 located on the slack side, i.e., the left-hand side of the above described timing chain 12 in FIG. 1, and crankshaft sprocket 9. By this, a force is applied to the timing chain 12 for suitably tensioning the same. Further, a chain guide 19 is disposed between the first intake valve operating camshaft sprockets 11 for slightly urging the timing chain 12 inward.

A water pump 1 is disposed between the other of the first intake valve operating camshaft sprockets 11 located on the stretched side, i.e., the right-hand side of the timing chain 12 in FIG. 3, and the crankshaft sprocket 9. The water pump 1 includes a drive shaft 20 and a water pump sprocket 21 installed thereon. The water pump sprocket 21 is located outside of the timing chain 12, i.e., outside of the triangular area bounded by the timing chain 12. The water pump sprocket 21 is located nearly at the middle between first intake valve operating camshaft sprocket 11 and the crankshaft sprocket 9 and arranged so as to push the timing chain 12 inward. Chain guides 22 and 23 are disposed above and below the water pump sprocket 21, respectively.

Figure 2:
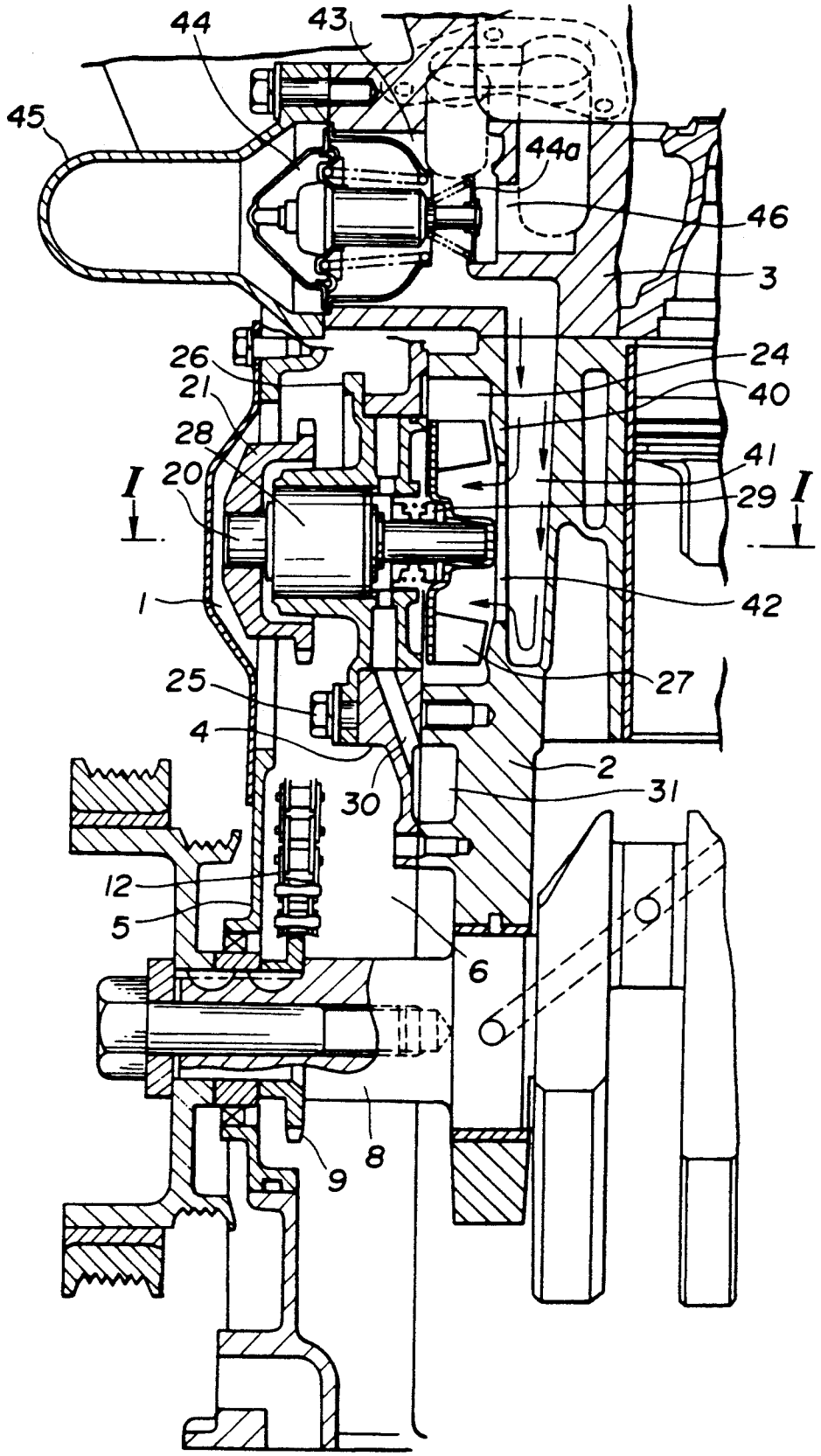
FIG. 2 is a sectional view of a front end portion of the engine of FIG. 1.

The water pump 1, as shown in FIGS. 1 and 2, mainly consists of a pump chamber 24 formed in a front end portion of the cylinder block 2, a pump housing 26 secured with bolts 25 to the chain case rear member 4 in such a manner as to cover the pump chamber 24, and an impeller 27 secured to an end of the drive shaft 20. The drive shaft 20 is rotatably supported on the pump housing 26 by means of a bearing 28 in the form of a journal bearing. In order to prevent intrusion of coolant into the baring 28, a mechanical seal 29 is interposed between the impeller 27 and the pump housing 26. In order that a small amount of coolant having passed the above described mechanical seal 29 is discharged or drained to the outside, the chain case rear member 4 is formed with a drain passage 30 communicating a space 31 between the cylinder block 2 and the chain case rear member 4. The space 31 is in turn communicated with the outside or open air.

As shown in FIGS. 1 and 4, the pump chamber 24 receiving therewithin the impeller 27 is arranged in the front end portion of the bank having the cylinders which are offset more rearward than those of the other bank. The pump chamber 24 is nearly circular in shape and connected at an upper end portion thereof with a discharge port 32 extending in the tangential direction of the pump chamber 24. The discharge port 32 is connected to a coolant distribution chamber 33 formed in a front end portion of the cylinder block 2 midway between the banks. The coolant distribution chamber 33 is in turn communicated with water jackets 34 and 35 formed in the left and right banks of the cylinder block 2. More specifically, the water jacket 34 of the left bank has a coolant inlet port 36 by the side of the first cylinder #1 which is located nearest to the front end of the left bank, from the front or most forward of the engine so that the coolant inlet port 36 provides communication between the coolant distribution chamber 33 and the water jacket 34. On the other hand, the water jacket 35 of the right bank has a coolant inlet port 37 by the side of the second cylinder #2 which is located nearest to the front end of the right bank, from the front or most forward of the engine so that the coolant inlet port 37 provides communication between the coolant distribution chamber 33 and the water jacket 35. A barrier or dam 38 is formed in a nearly central portion of the coolant distribution chamber 33 so that a part of the coolant having flown into the coolant distribution chamber 33 changes its direction of flow as shown by the arrows in FIG. 1 so as to be introduced into the coolant inlet port 37 of the right bank.

The coolant distribution chamber 33, for the reason of manufacture, is formed so as to have an opened front end which is closed by the chain case rear member 4 and is sealed against the same.

In FIG. 1, coolant inlet ports 39*a* and 39*b* opening to the bottom ends of the respective cylinder heads 3 are shown by two-dot chain lines. Coolant is introduced to the cylinder heads 3 through the coolant inlet ports 39*a* and 39*b*, respectively.

Formed in the cylinder block 2 at the rear of the pump chamber 24, i.e., at a location between the pump chamber 24 and the water jacket 35 is a coolant introducing chamber 41 which is communicated with the pump chamber 24 via a thin partition wall 40. The coolant introducing chamber 41 has an opened upper end, i.e., has an open end on the cylinder head 3 side. The partition wall 40 is formed with a communication hole 42 axially aligned with the impeller 27 and providing communication between the coolant introducing chamber 41 and the pump chamber 24.

Figure 5:
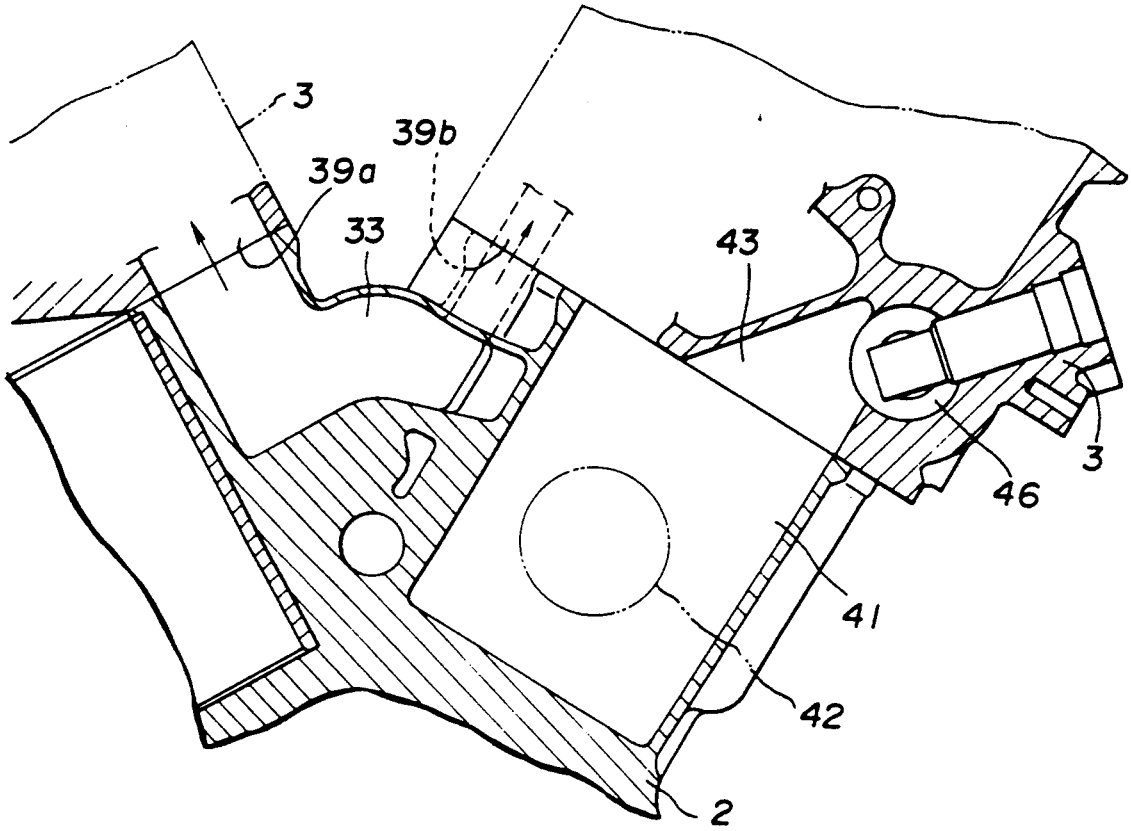
FIG. 5 is a sectional view taken along the line V—V of FIG. 1.

In order to introduce coolant smoothly into the pump chamber 24, the coolant introducing chamber 41 is formed into a rectangular shape which is sized to be sufficiently large as compared with the opening 42, i.e., the coolant introducing chamber 41 is sized to be sufficiently large so as to have a sufficiently large portion extending radially outward from the peripheral edge of the communication hole 42 (refer to FIG. 5).

The coolant introducing chamber 41, as shown in FIG. 2, is communicated at the upper end with the inside of a thermostat housing 43 provided to one of the cylinder heads 3. The thermostat housing 43, as shown in FIG. 4, is formed into a cup-like shape opening forward of the engine. An inlet tube 45 housing therewithin a thermostat valve 44 is secured to the thermostat housing 43. The thermostat housing 43 is communicated at its inner bottom end with a bypass passage 46 which is opened and closed by a bypass valve 44*a*.

Figure 6:
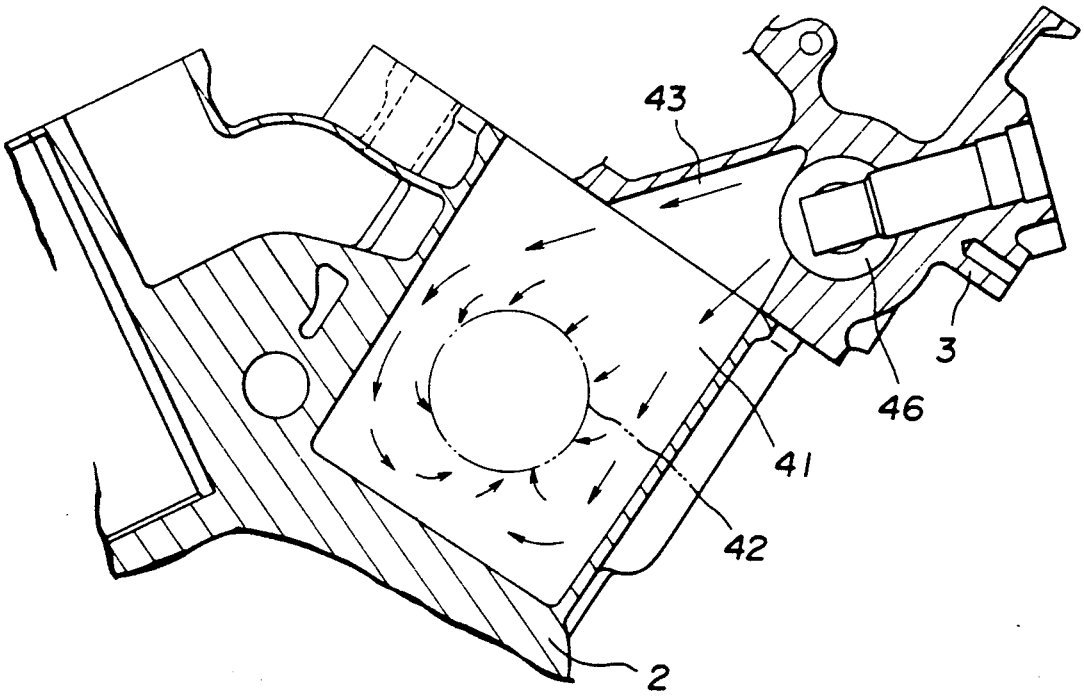
FIG. 6 is a view similar to FIG. 5 representing by the arrows uniform flow of coolant from a coolant introducing chamber into a pump chamber through a communication hole therebetween.
Figure 7:
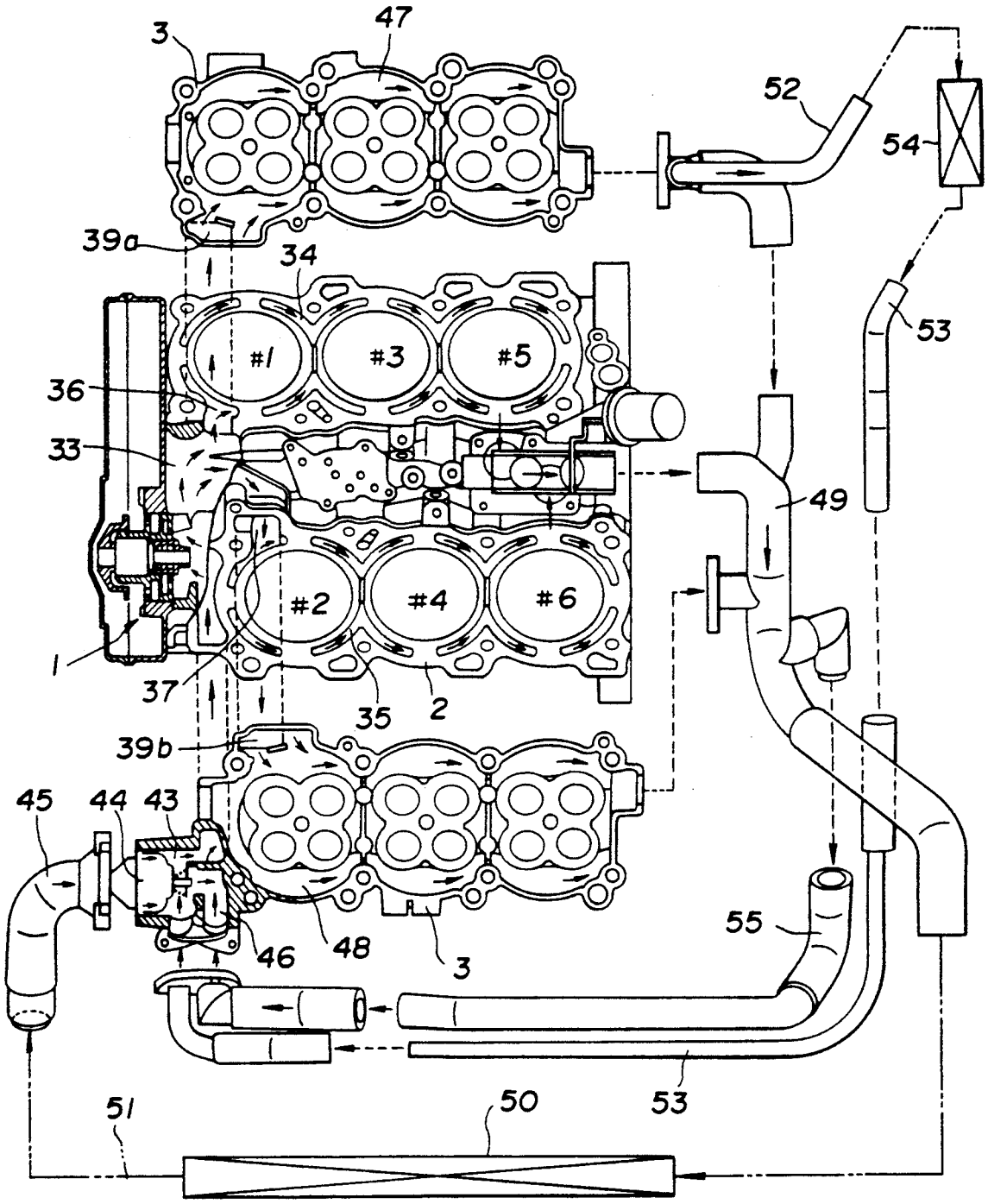
FIG. 7 is a schematic view of an entire cooling system of the engine of FIG. 1.
Figure 8:
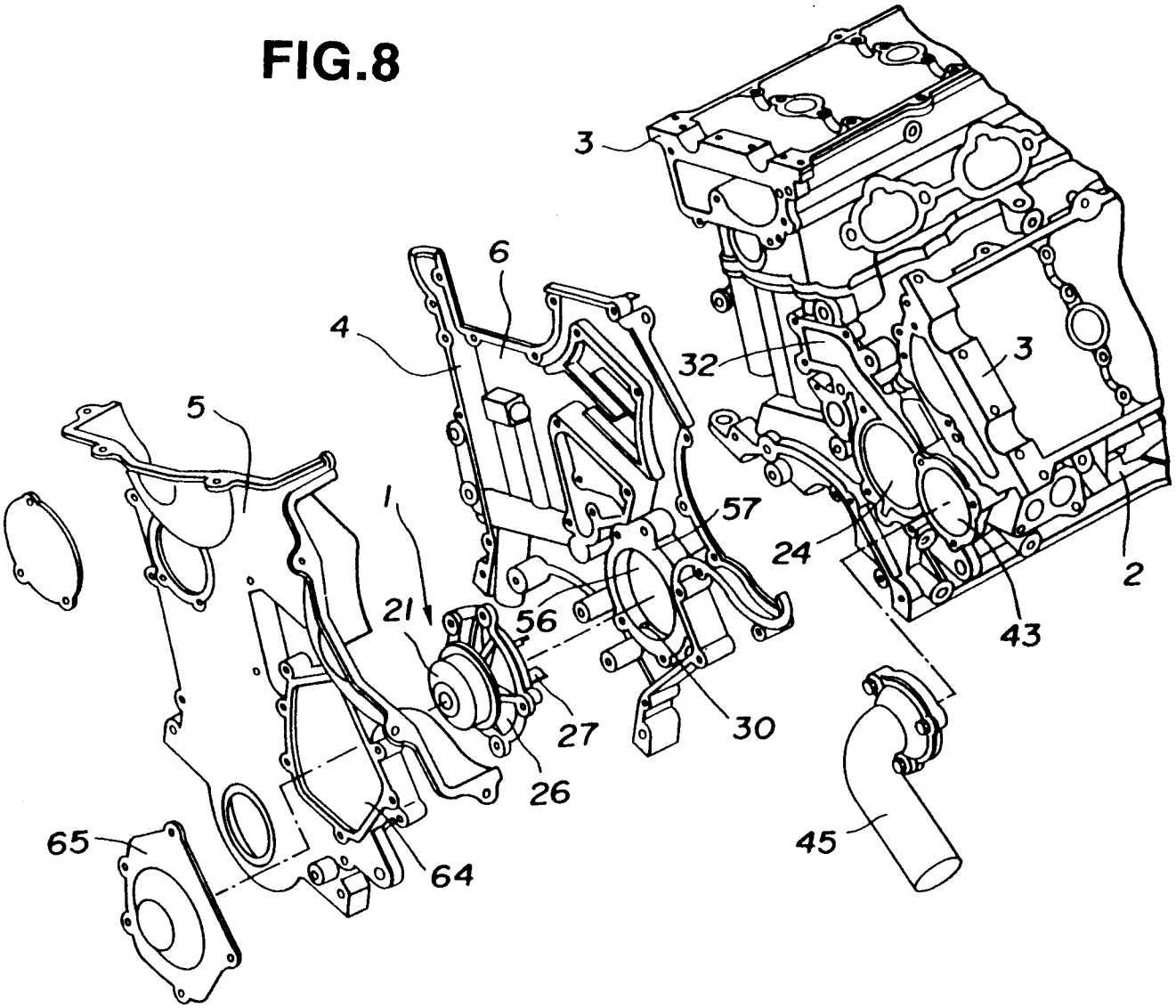
FIG. 8 is an exploded view of the front end portion of the engine of FIG. 1.

FIG. 6 shows an entire cooling system incorporating the water pump arrangement of the present invention. Referring to FIG. 6, flow of coolant through the cooling system will be described hereinbelow.

Coolant pressurized by the water pump 1 is forced to flow from the front end of the cylinder block 2 into the water jackets 34 and 35 of the cylinder block 2 and the water jackets 47 and 48 of the cylinder heads 3 and then rearward of the engine. Thereafter, coolant is discharged from the coolant outlet at the rear end of the engine and conducted through a coolant passage 49 to a radiator 50. From the radiator 50, coolant is conducted by way of the inlet tube 45 to the thermostat housing 43 and flows through the thermostat valve 44 into the water pump 1 again. When the temperature of coolant is low to cause the thermostat valve 44 to be held closed, coolant discharged from the coolant outlet at the rear end portion of the engine is conducted through the bypass passage 55 and returned back to the water pump 1 through the bypass passage 46 in the thermostat housing 43.

Figure 9:
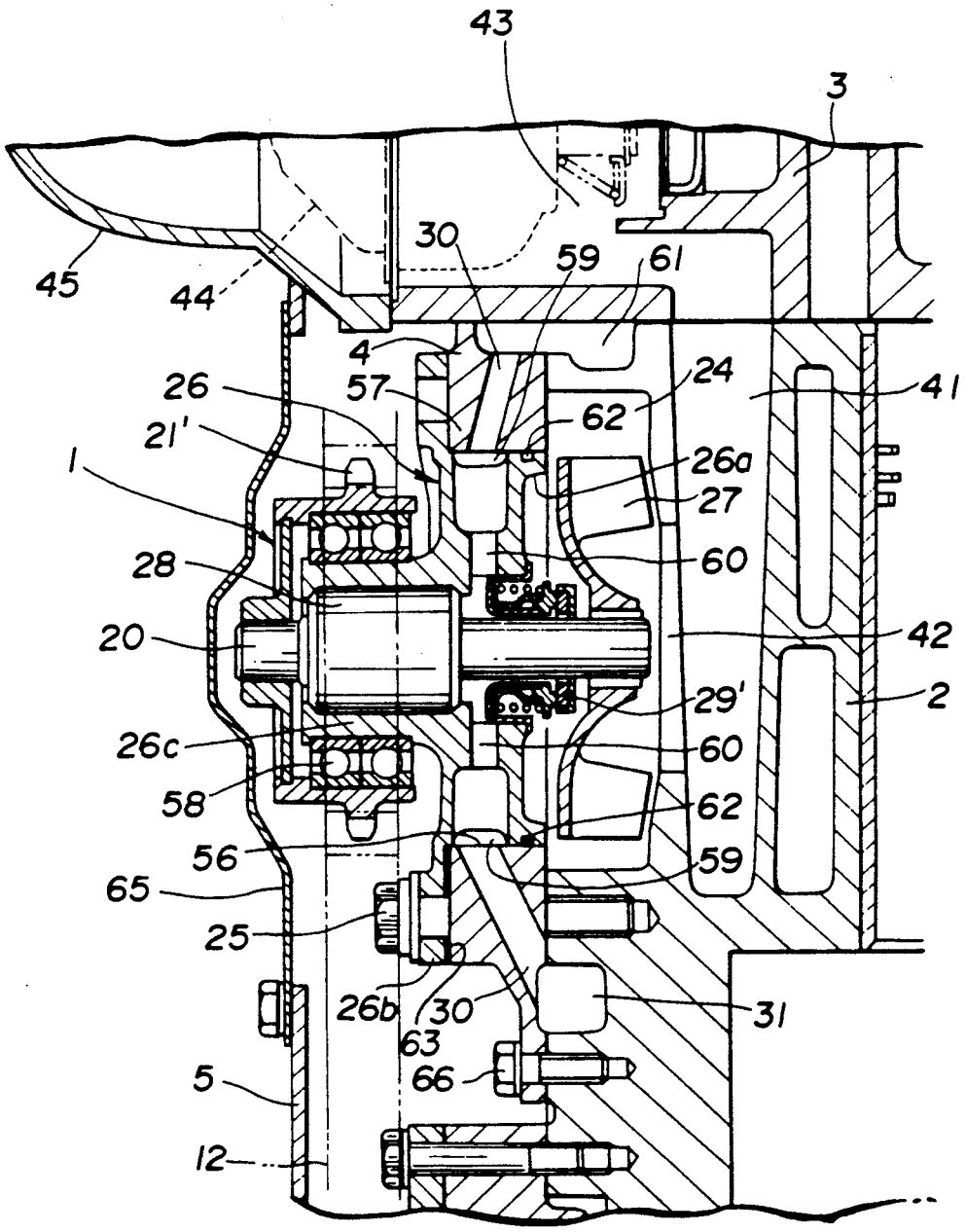
FIG. 9 is a sectional view of a water pump arrangement according to a modification of the present invention.
Figure 10:
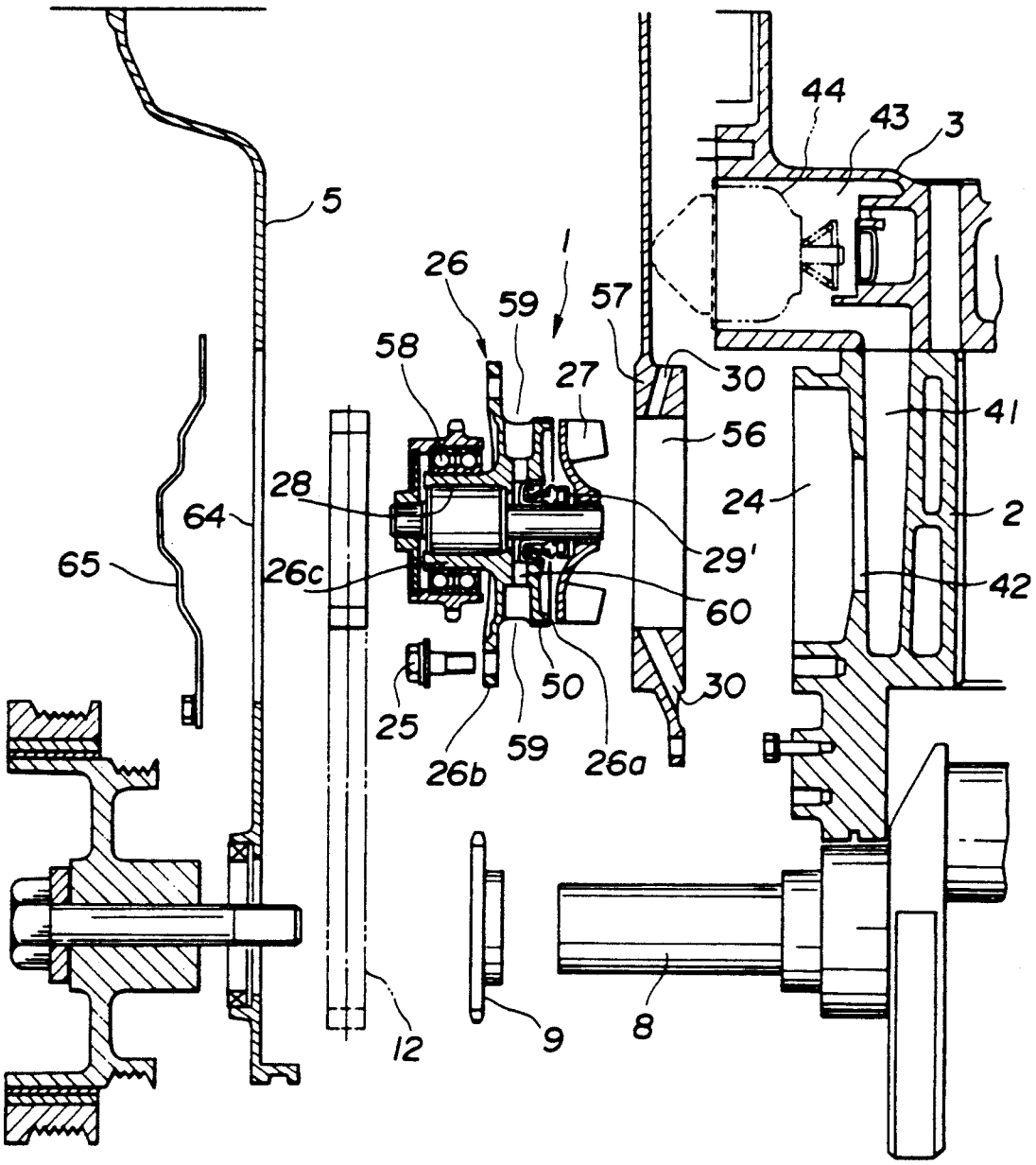
FIG. 10 is an exploded view of the water pump and its associated part of FIG. 9.

Referring to FIGS. 9 and 10 in which the water pump sprocket 21', the mechanical seal 29', etc. are shown in modified forms, the water pump 1 will be described more in detail.

The pump housing 26 includes an annular joining portion 26*a* fitted in an opening 56 formed in a flange portion 57 of the chain case rear member 4, a flange portion 26*b* placed on the flange portion 57 of the chain case rear member 4 and secured thereto with the bolts 25 as described hereinbefore, and a bearing support portion 26*c* for supporting thereon a bearing 58. The water pump sprocket 21' is shown in a modified form and rotatably installed by way of the bearing 58 on the bearing support portion 26*c* of the pump housing 26. The mechanical seal 29' is interposed between the inner periphery of the joining portion 26*a* of the pump housing 26 and the impeller 27 for providing a seal therebetween in such a manner as to allow them to rotate relative to each other.

The annular joining portion 26*a* of the pump housing 26 is formed with, at the outer periphery thereof, a relative shallow groove 59 extending throughout the circumference thereof. The groove 59 is communicated through radial passages 60 formed in the pump housing 26 with a space between the mechanical seal 29' and the bearing 28. At least two radial passages 60 are formed in the pump housing 26 and disposed in the upper and lower places, respectively. The flange portion 57 of the chain case rear member 4 around the opening 56 is formed with the aforementioned drain passages 30 which extend slantwise to open at one end to the the opening 56 of the chain case rear member 4 and at the other end to the rear face of the chain case rear member 4. By the drain passages 30, the groove 59 at the outer periphery of the joining portion 26*a* of the pump housing 26 is communicated with the cavity 31 and a cavity 61 provided between the chain case rear member 4 and the cylinder block 2 and opening to the open air.

The annular joining portion 26*a* of the pump housing 26 is provided with, at an outer periphery thereof and in the place adjacent to a free end thereof, i.e., in the place located nearer to the pump chamber 41 than the groove 59, an O-ring 62 serving as a first sealing means for providing a seal between the chain case rear member 4 and the flange portion 26*b* of the pump housing 26. As shown in an exaggerated manner in FIG. 9, a liquid gasket 63 serving as a second sealing means is applied to the joining surfaces of the the flange portion 26*b* of the pump housing 26 and the flange portion 57 of the chain case rear member 4 around the opening 56 for thereby providing a seal between the pump housing 26 and the chain case rear member 4.

The chain case front member 5 is formed with an access hole 64 for access to the water pump 1. The access hole 64 is closed by an independent front cover 65. The chain case rear member 4 is secured with a plurality of bolts 66 to the front end of the cylinder block 2. A liquid seal is applied to the joining surfaces of the chain case rear member 4 and the cylinder block 2, for example the joining surfaces thereof around the pump chamber 24 for providing a seal therebetween.

In the foregoing structure, it is to be noted that the water pump 1 is arranged in the front end portion of the bank having the cylinders which are offset more rearward of the engine than those of the other bank and that coolant is supplied to the water jackets 34 and 35 through inlet ports 36 and 37 formed in the lateral walls defining the same, i.e., the inlet ports 36 and 37 are formed in the water jacket portions by the side of the most forward cylinders in such a manner as to open radially of the engine. By this, as seen from FIG. 1, the water pump 1 can be arranged more rearward as compared with that in the the prior art arrangement, thus making it possible to reduce the lengthwise size of the engine considerably.

It is to be further noted that the water pump 1 is adapted to be driven by the timing chain 12 for driving the valve operating mechanism, thus enabling the water pump 1 to be housed compactly within the chain chamber 6, whilst making it possible to attain a compact layout of a V-belt for driving engine accessories and therefore a compact front end structure of the engine.

It is to be further noted that while the water pump 1 is arranged on one side of the engine, equal distribution of coolant to the water jackets of the left and right banks can be attained since coolant is distributed to the left and right banks through the coolant distributing chamber 33 arranged at the middle between the banks.

It is to be further noted that the space between the mechanical seal 29' and the bearing 28 is communicated with the open air such that vapor produced in that space is drained off mainly through the upper drain passages 30 and 60 to the outside, whilst coolant having passed the mechanical seal 29' is drained off mainly through the lower drain passages 30 and 60 to the outside. The pump housing 26 is double-sealed by means of the O-ring 62 and the liquid gasket 63 with respect to the chain case rear member 4, whilst the spaces 31 and 61 communicated with the open air are provided between the seals. By this, even if leakage through the O-ring occurs due to deterioration or degradation, the leaked coolant will be drained off through the drain passages 30 at once, thus assuredly preventing intrusion of coolant into the chain chamber 6 through the liquid gasket 63. Accordingly, lubricant of the engine is assuredly prevented from being mixed with coolant at the chain chamber 6.

It is to be further noted that upon introduction of coolant from the thermostat housing 43 to the water pump 1 coolant once flows into the coolant introducing chamber 41 and then into the pump chamber 24 through the opening 42 after being sufficiently reduced in the velocity of flow. In other words, coolant flows into the opening 42 after becoming sufficiently mild in the component of velocity. Further, the coolant introducing chamber 41 has a sufficient area or extension around the opening 42. The coolant within the coolant introducing chamber 41 thus can flow into the opening 42 equally from the circumference thereof as indicated by arrows in FIG. 6. Accordingly, the flow resistance on the intake side of the water pump 1 is reduced for thereby improving the operating efficiency of the water pump 1 and eliminating or at least reducing the tendency to cavitation. The coolant introducing chamber 41 of a rectangular shape is effective for reducing the lengthwise size of the engine while attaining a sufficiently large size. Thus, increase in the lengthwise size of the cylinder block 2 due to the arrangement for introduction of coolant from the cylinder block 2 side to the water pump 1 can be prevented, and no obstacle to making the engine smaller in size is caused.

What is claimed is:

1. A V-type internal combustion engine comprising:

a cylinder block having banks one of which has cylinders which are offset more rearward of the engine than those of the other of said banks;

said one bank having at a front end thereof a recessed portion;

a water pump having a pump housing secured to the front end of said one bank and cooperating with said recessed portion to define a pump chamber;

said cylinder block having at a front end portion between said banks a coolant distributing chamber communicating with an outlet port of said pump chamber; and said cylinder block having at said banks water jackets which are formed with, at respective front end portions by the side of the most forward ones of said cylinders, inlet ports opening laterally of the engine and communicating said coolant distributing chamber.

2. A V-type internal combustion engine according to claim 1, wherein said coolant distributing chamber is provided with dam means for introducing coolant discharged from said water pump equally to said inlet ports of said water jackets.

3. A V-type internal combustion engine according to claim 2, further comprising cylinder heads installed on said banks of said cylinder block, respectively, said cylinder heads having at front ends thereof inlet ports communicating with coolant distributing chamber.

4. A V-type internal combustion engine according to claim 1, further comprising a chain case rear member secured to the front end of said cylinder block and a chain case front member secured to said chain case rear member in such a manner that said chain case rear member and said chain case front member cooperate with said cylinder block to define a chain chamber, said chain case rear member having a flange portion formed with an opening axially aligned with said pump chamber, said pump housing having a flange portion secured to said flange portion of said chain case rear member and an annular joining portion fitted in said opening of said chain case rear member, said water pump having an impeller installed in said pump chamber and rotatably supported by bearing means on said pump housing, a mechanical seal interposed between said impeller and said pump housing for providing a seal therebetween, a cavity provided between said cylinder block and said chain case rear member and communicating with an open air, a drain passage formed in said flange portion of said chain case rear member for connecting said cavity to a space between said bearing and said mechanical seal, first sealing means for providing a seal between an inner circumferential surface of said flange portion of said chain case rear member defining said opening and said joining portion of said pump housing at a place nearer to said pump chamber than said space, and second sealing means for providing communication between said flange portions of said pump housing and said chain case rear member at a place nearer to said chain chamber than said cavity.

5. A V-type internal combustion engine according to claim 4, further comprising a second cavity provided between said cylinder block and said chain case rear member and communicating with an open air, a second drain passage formed in said flange portion of said chain case rear member for connecting said second cavity to said space between said bearing and said mechanical seal, said second cavity being located at a place higher than said space, said second drain passage being arranged so as to extend upwardly from said space, said first mentioned cavity being located at a place lower than said space, said first mentioned drain passage being arranged so as to extend downwardly from said space.

6. A V-type internal combustion engine according to claim 5, wherein said annular joining portion of said pump housing is formed with radial passages for connecting said first and second drain passages to said space, respectively.

7. A V-type internal combustion engine according to claim 6, wherein said first sealing means comprises an O-ring installed on said joining portion of said pump housing.

8. A V-type internal combustion engine according to claim 7, wherein said second sealing means comprises a liquid seal applied to joining surfaces of said flange portions of said pump housing and said chain case rear member.

9. A V-type internal combustion engine according to claim 8, wherein said water pump further comprises a pump shaft on which said impeller is installed for rotation therewith, said pump housing having a bearing support portion rotatably supporting said pump shaft by way of said bearing means, said mechanical seal being installed on said pump shaft for providing a seal between said pump shaft and an inner circumferential surface of said joining portion of said pump housing.

10. A V-type internal combustion engine according to claim 9, wherein said bearing means comprises a journal bearing.

11. A V-type internal combustion engine according to claim 1, wherein said water pump has an impeller installed in said pump chamber, and said one bank of said cylinder block has in the rear of said pump chamber a coolant introducing chamber and a partition wall interposed between said coolant introducing chamber and said pump chamber, said partition wall having a communication hole axially aligned with said impeller and providing communication between said coolant introducing chamber and said pump chamber, said coolant introducing chamber having a large extent of space extending radially of and around said communication hole.

12. A V-type internal combustion engine according to claim 11, wherein said coolant introducing chamber is rectangular.

13. A V-type internal combustion engine comprising:

a cylinder block;

a water pump having a pump chamber formed at a front end of said cylinder block;

a chain case rear member secured to the front end of said cylinder block;

a chain case front member secured to said chain case rear member;

said chain case rear member and said chain case front member cooperating with said cylinder block to define a chain chamber;

said chain case rear member having a flange portion formed with an opening axially aligned with said pump chamber;

said pump housing having a flange portion secured to said flange portion of said chain case rear member and an annular joining portion fitted in said opening of said chain case rear member;

said water pump further having an impeller installed in said pump chamber and rotatably supported by bearing means on said pump housing;

a mechanical seal interposed between said impeller and said pump housing for providing a seal therebetween;

cavity means provided between said cylinder block and said chain case rear member and communicating with an open air;

drain passage means formed in said flange portion of said chain case rear member for connecting said cavity means to a space between said bearing and said mechanical seal;

first sealing means for providing a seal between an inner circumferential surface of said flange portion of said chain case rear member defining said opening and said joining portion of said pump housing at a place nearer to said pump chamber than said space; and second sealing means for providing communication between said flange portions of said pump housing and said chain case rear member at a place nearer to said chain chamber than said cavity.

14. A V-type internal combustion engine according to claim 13, wherein said cavity means comprises a first cavity located higher than said space and a second cavity located lower than said space, and said drain passage means comprises a first drain passage extending upwardly from said space for connecting said space to said first cavity and a second drain passage extending downwardly from said space for connecting said space to said second cavity.

15. A V-type internal combustion engine according to claim 14, wherein said annular joining portion of said pump housing is formed with radial passages for connecting said first and second drain passages to said space, respectively.

16. A V-type internal combustion engine according to claim 15, wherein said first sealing means comprises an O-ring installed on said joining portion of said pump housing.

17. A V-type internal combustion engine according to claim 16, wherein said second sealing means comprises a liquid seal applied to joining surfaces of said flange portions of said pump housing and said chain case rear member.

18. A V-type internal combustion engine according to claim 17, wherein said water pump further comprises a pump shaft on which said impeller is installed for rotation therewith, said pump housing having a bearing support portion rotatably supporting said pump shaft by way of said bearing means, said mechanical seal being installed on said pump shaft for providing a seal between said pump shaft and an inner circumferential surface of said joining portion of said pump housing.

19. A V-type internal combustion engine according to claim 18, wherein said bearing means comprises a journal bearing.

* * * * *